United States Patent [19]

Landis

[11] 4,154,580

[45] May 15, 1979

[54] METHOD FOR PRODUCING A STABILIZED GASOLINE-ALCOHOL FUEL

[75] Inventor: Phillip S. Landis, Woodbury, N.J.

[73] Assignee: Mobil Oil Corporation, New York, N.Y.

[21] Appl. No.: 867,725

[22] Filed: Jan. 9, 1978

Related U.S. Application Data

[63] Continuation-in-part of Ser. No. 683,864, May 6, 1976, abandoned, which is a continuation-in-part of Ser. No. 453,612, Mar. 22, 1974, abandoned.

[51] Int. Cl.[2] ..... C10L 1/02

[52] U.S. Cl. ..... 44/56

[58] Field of Search ..... 260/641; 44/53, 56; 568/715

[56] References Cited

U.S. PATENT DOCUMENTS

| | | | |
|---|---|---|---|
| 1,752,724 | 4/1930 | Bourie | 44/56 |
| 1,757,838 | 5/1930 | Johns | 44/56 |
| 2,078,736 | 4/1937 | Schurink | 44/56 |
| 2,365,009 | 12/1944 | Robertson | 44/53 |
| 2,429,707 | 10/1947 | Catalano | 44/56 |
| 3,455,664 | 7/1969 | Rosscup et al. | 44/53 |
| 3,705,912 | 12/1972 | Massie | 260/641 |
| 3,822,119 | 7/1974 | Frech et al. | 44/56 |

*Primary Examiner*—Allen B. Curtis
*Assistant Examiner*—Y. Harris-Smith
*Attorney, Agent, or Firm*—Charles A. Huggett; Raymond W. Barclay; Thomas S. Szatkowski

[57] ABSTRACT

Stable gasoline-alcohol fuel mixtures are produced by hydration of a gasoline or a fraction thereof high in olefins in the presence of an acid catalyst to form a high alcohol content gasoline mixture, which mixture is blended with a gasoline containing up to about 20 volume percent of methanol. The addition of the catalytically hydrated gasoline or olefinic fraction thereof serves to maintain the methanol in complete solution at low temperatures, particularly in the presence of water contaminant.

11 Claims, 1 Drawing Figure

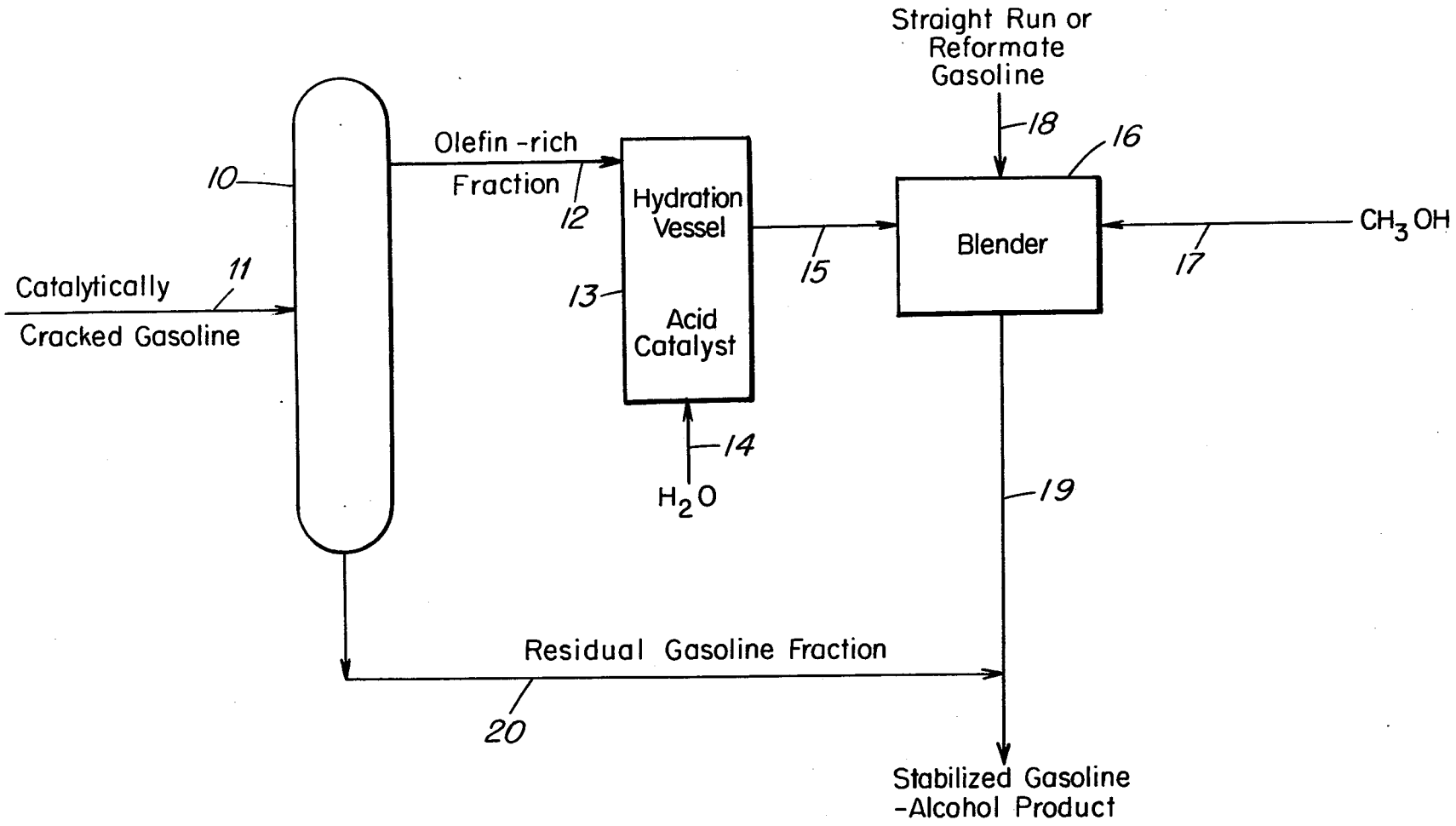
Catalytically Cracked Gasoline
11
10
Olefin -rich Fraction
12
Hydration Vessel
Acid Catalyst
13
14
$H_2O$
15
Straight Run or Reformate Gasoline
18
16
Blender
17
$CH_3OH$
19
Stabilized Gasoline -Alcohol Product
Residual Gasoline Fraction
20

METHOD FOR PRODUCING A STABILIZED GASOLINE-ALCOHOL FUEL

CROSS-REFERENCE TO RELATED APPLICATION

This application is a continuation-in-part of my copending application, Ser. No. 683,864, filed May 6, 1976, now abandoned which in turn is a continuation-in-part of copending application, Ser. No. 453,612, filed Mar. 22, 1974, and now abandoned.

BACKGROUND OF THE INVENTION

1. Field of the Invention

This invention pertains to an improved method for reducing the olefin content of cracked gasolines without the reduction of octane which is inherent in the prior art (hydrogenation) methods. This invention also pertains to extension of scarce petroleum supplies by utilization of methanol as a component in a gasoline blend and to stabilization of gasoline-methanol mixtures against phase separation at low temperatures or in the presence of water contaminent.

2. Description of Prior Art

In order to produce gasoline and other fine products, the modern refiner is forced to operate under an ever-growing series of constraints. Gasoline product specifications, for example, are now set by government. One important specification involves the bromine number of the final gasoline product, which is a measure of the olefin content of the product.

Since unburned olefins emitted from automobile exhausts interact in the atmosphere with ozone and $NO_x$ to produce smog forming components, it is ecologically desirable to reduce the olefin content of gasoline in order to reduce the amounts emitted as unburned hydrocarbons and, ultimately, smog. Gasolines marketed in California, for example, must have a bromine number of less than 30, which translates to an olefin content of approximately 10 wt %. A typical gasoline from a cracking unit, such as Fluid Catalytic Cracking (FCC) or Thermofor Catalytic Cracking (TCC), however, may have an olefin content of 20 wt % or more. Thus, to meet the prescribed product specifications, the refiner must hydrogenate a large quantity of the olefins present in cracked gasoline. Besides being very expensive, hydrogenation of olefins presents another major problem to the refiner since such hydrogenation generally causes the gasoline product to lose from about 2 to 10 Research Octane Numbers. This loss of octane is due to conversion of higher octane olefinic components to lower octane paraffinic components.

In addition to the constraints described above, the modern refiner is also faced with a decreasing availability of desirable crudes. As the amounts of these desirable crudes decreases, the refiner will be forced to use crudes of much poorer quality. Therefore, it will become more and more difficult to produce desired quantities of gasoline which meet the prescribed product specifications. For example, if the refiner is forced to utilize a heavier crude, more gasoline must be produced by catalytic cracking. Such gasoline would have a high olefinic content and would not, without further treatment, meet the bromine number specifications discussed hereinabove.

In order to produce sufficient quantities of gasoline, the refiner must begin to look to non-conventional feedstocks. One such feedstock is alcohol, particularly methanol, which can be produced from abundant coal supplies with existing technology. Indeed, gasolines containing variable amounts of methanol, often 5 to 20 volume percent, have heretofore been proposed as a potentially economical technique for extending gasoline supplies.

The use of gasoline-methanol mixtures, however, has been accompanied by at least two major disadvantages. First, a 10 percent solution of methanol in some gasolines is soluble at room temperature, but separates at low temperatures because of decreased solubility. This problem becomes even more acute when methanol is blended with a gasoline in which the olefins have been hydrogenated to paraffins because methanol is even less soluble in paraffinic stocks than in aromatic or olefinic stocks. Also, the presence of small amounts of water, say 0.1 to 1%, can effect phase separation causing removal of some of the methanol from the gasoline into the water phase.

It has heretofore been reported that certain additive materials, e.g. isobutanol at 2.4% added to a mixture of 10% methanol in gasoline, will maintain the methanol in solution at low temperatures and possibly improve the water tolerance. The principal problem with such approach has been the cost and availability of the additive materials.

The following U.S. patents disclose alcohol-gasoline fuel in which large percentages of petroleum products are avoided. U.S. Pat. No. 1,527,504 shows a fuel with 40–60% methanol, the remainder being benzol and gasoline. In U.S. Pat. No. 1,516,907, the fuel contains 40–70% methanol, the remainder being gasoline. Finally, U.S. Pat. No. 1,474,135 shows a fuel with 25–50% butyl alcohol, the remainder being gasoline. The disclosure of fuels having major proportions of alcohols and smaller amounts of petroleum derived products is contrary to present invention which relates to the use of minor amounts of alcohols to extend gasoline supplies. None of the above patents discloses the components nor the proportions employed in the present invention.

In U.S. Pat. No. 2,087,582, there is disclosed a three component fuel blend consisting of gasoline, alcohol and a metallic-organic anti-knock agent. Again, this patent does not show nor suggest the invention described and claimed herein.

U.S. Pat. No. 3,455,664 teaches that isopropyl alcohol can be produced by hydration of propylene and added to a motor fuel by an extraction process. This patent does not teach hydration of olefinic gasoline nor fuel mixtures of gasoline, methanol and alcohols produced from hydration of olefinic gasoline.

U.S. Pat. No. 3,705,912 merely teaches treating an olefinic component with water in the presence of specific catalysts to produce the corresponding alcohol.

BRIEF DESCRIPTION OF DRAWING

The invention is described in conjunction with the accompanying drawing in which:

The single FIGURE illustrates, in schematic form, a mode of operation for conducting the described hydration and blending operation.

SUMMARY OF THE INVENTION

The present invention provides a method for concurrently producing gasoline which meets bromine number specifications, without loss of octane, and utilizing methanol as a gasoline extender without phase separation at low temperatures or in the presence of a water contaminant. The product formed is a high octane stabilized gasoline-alcohol fuel blend, which consists essentially of (1) a major proportion of gasoline and (2) minor proportions of (a) methanol and (b) higher mixed low molecular weight alcohols resulting from hydration of a gasoline or fraction thereof high in olefins.

In accordance with the present invention, the bromine number of cracked gasolines is brought within the required limit (i.e. olefins are removed from the product) without loss of octane by hydration to convert the olefins contained therein to mixed alcohols, high in octane.

Also, in accordance with the present invention, stabilization of gasoline-methanol mixtures with respect to phase separation is accomplished by the addition to such mixtures of a gasoline or fraction thereof high in olefin content which has undergone hydration to convert the olefins contained therein to mixed alcohols. By blending the resulting high alcohol content gasoline, in controlled amount, with the mixture of gasoline and methanol, an overall stabilized gasoline-alcohol product with a very high octane is obtained. This high octane stabilized gasoline-alcohol product also has the ability to counteract phase separation upon exposure to low temperatures and/or the presence of small amounts of water contaminant.

The two step method of this invention for producing a stabilized gasoline-alcohol fuel blend comprises:

(a) hydrating a gasoline or fraction thereof high in olefins to remove olefins in order to meet bromine number specifications thus forming a high octane mixture containing between about 10% and 60% by weight of low molecular weight alcohols; and (b) blending an amount of the resultant high alcohol content gasoline or gasoline fraction with a major proportion of gasoline and 5 to 20 volume percent of methanol, said amount, based on alcohol content, being between about 2 and about 20 volume percent of the gasoline-methanol mixture.

It is noted that with the above method, low molecular weight alcohols which are high in octane are formed directly in the gasoline or fraction thereof high in olefins which is subsequently blended with the gasoline-methanol mixture. Thus, there is no need for costly separation of alcohols prior to the blending step.

The gasoline employed may be obtained by any of the commercial processes available for cracking petroleum fractions, such as gas oil, either thermally or in the presence of a heterogeneous catalyst, e.g. a crystalline aluminosilicate zeolite catalyst, to yield lighter boiling material in the gasoline range. Thus, it is contemplated that either a compact moving bed (TCC) or a fluidized bed (FCC) cracking process operated under conventional conditions will effectively provide substantial quantities of olefin-containing gasoline to be utilized in the present process. Typical hydrocarbon composition breakdown of $C_5+$ cracked gasolines in weight percent are as follows:

| | FCC Gasoline | TCC Gasoline |
|---|---|---|
| Paraffins | 24–29 | 20–25 |
| Olefins | 18–20 | 25–35 |
| Naphthenes | 10–11 | 5–10 |
| Aromatics | 36–39 | 25–30 |
| Indanes, Tetralins Naphthalenes | 4–8 | 5–10 |

The olefin content of the total dry gas+$C_5+$ gasoline effluent from an FCC cracking unit typically contains the following:

| | Weight Percent |
|---|---|
| Ethylene | 1.6 |
| Propylene | 6.4 |
| Butenes | 6.2 |
| Pentenes | 7.2 |
| Hexenes + Heptenes | 7.0 |

For the $C_5+$ gasoline fraction the olefin content includes pentenes, hexenes and heptenes together with small amounts of higher olefins up to $C_5+$. Thus, upon hydration, any ethylene or propylene would yield ethanol and isopropanol respectively; butenes provide mixed tertiary and secondary butanols; pentenes provide tertiary and secondary amyl alcohols and hexenes yield tertiary and secondary hexyl alcohols.

It is also within the purview of this invention to employ a fraction of the above-described gasolines which is high in olefin content. The use of such fraction may be considered to be a preferred embodiment of the invention in that hydration facilities can be minimized to treat the particular fraction of interest. Such fraction is readily separated from the remaining gasoline components by fractionation or by adsorption of the olefins in sulfuric acid, which later may be either separated from the sulfuric acid or hydrated directly employing the sulfuric acid as a catalyst. Typical olefin analyses of other streams from FCC cracking include debutanizer overhead 29.6%$C_3$−− and 24.9%$C_4$−−, primary absorber offgas 13.0%$C_2$−−, 1.6%$C_3$−− and 0.1 $C_4$−− and debutanizer bottoms 0.4%$C_4$−−, 7.0%$C_5$−− and 28.0%$C_6$−− and heavier.

The conversion of olefins contained in the gasoline or olefinic fraction thereof to corresponding alcohols is effectively carried out by reaction with water in the presence of acid catalysts utilizing techniques and conditions well known in the art. Representative catalysts which may be used include sulfuric acid; aryl sulfonic acids; phosphoric acid and phosphoric acid deposited on a suitable support, such as silica, charcoal or celite; acid phosphates such as cadmium metaphosphate or boron phosphate; resin sulfonic acids; acid clays and acidic zeolites, tungstic acid, molybdic acid and acidified aqueous alumina gels.

Hydration of the olefin-containing gasoline or fraction thereof is effected by bringing a stream of the charge and water into contact with a catalyst of the above type at a temperature between about 50° C. and about 300° C. and a pressure between about 1 and about 500 atmospheres, utilizing a water olefinic hydrocarbon molar ratio within the approximate range of 1:1 to 5:1. When a catalytically cracked gasoline, as such, is employed as the charge, in the above operation the other constitutents, aside from olefins, are not affected by the hydration reaction.

The resulting product of hydration constituting a gasoline containing mixed low molecular weight alcohols, which may be a mixture of $C_5$–$C_7$ alcohols, $C_4$–$C_7$ alcohols or $C_2$–$C_7$ alcohols is then blended, in a controlled amount, with a gasoline, which may be a straight run gasoline, a reformate or an alkylate to which has been added an amount, say up to 20 volume percent, of methanol to provide a high octane, stable gasoline-alcohol product not susceptible of separation at low temperatures or in the presence of small amounts of water. The amount of gasoline containing mixed low molecular weight alcohols, as a result of hydration, which is combined with the principal gasoline-methanol mixture will depend on the methanol content of said mixture, the amount of water contaminant which may be present, the temperatures to which the gasoline-methanol mixture may be exposed and the content of mixed low molecular weight alcohols contained in the blending stream. In general, however, the amount of added gasoline containing mixed low molecular weight alcohols is between about 2 and about 20 volume percent (based on alcohol content) of the gasoline-methanol mixture. The low molecular weight alcohols produced by hydration will generally comprise tertiary and secondary alcohols. Thus, in one embodiment, the alcohol portion of the stabilized gasoline-alcohol fuel contains a major, i.e., at least 50 percent by volume, proportion of methanol, a primary alcohol, and lesser amounts of tertiary and secondary alcohols.

Referring to the attached FIGURE, there is shown, in schematic form, a system for conducting the described hydration and blending operation. Turning more particularly to this FIGURE, catalytically cracked gasoline is introduced into fractionator 10 through line 11. An olefin-rich fraction is withdrawn overhead through conduit 12 and introduced into hydration vessel 13 containing an acid hydration catalyst. Water is introduced into the hydration vessel through conduit 14. A stream of the hydrated olefin-rich gasoline fraction containing mixed low molecular weight alcohols is withdrawn through conduit 15 and introduced into blender 16. Methanol and straight run or reformate gasoline are introduced into the blender respectively through conduits 17 and 18. The blend of gasoline, methanol and the mixed low molecular alcohols resulting from hydration is withdrawn through outlet 19 and combined with the residual gasoline fraction from fractionator 10 passing through conduit 20 to yield the desired stabilized gasoline-alcohol product.

DESCRIPTION OF SPECIFIC EMOBODIMENTS

In order to illustrate the efficacy of the method of the present invention in producing gasolines which meet bromine number specifications without losing octane, two typical FCC gasoline compositions will be considered:

| | FCC Gasoline | |
|---|---|---|
| Composition, wt % | A | B |
| Paraffins (RON* = 71) | 31 | 12 |
| Olefins (RON* = 90) | 18 | 45 |
| Naphthenes (RON* = 79) | 17 | 9 |
| Aromatics (RON* = 110) | 34 | 34 |
| Octane, RON | 88 | 93.5 |

*from values reported in "Physical Constants of Hydrocarbons C1 to C10," ASTM Data Series Publication DS 4A.

It will be apparent that these gasolines are much too high in olefin content to meet bromine number specifications. In order to meet a bromine number maximum of 30, the olefin content of these gasolines must be reduced to about 10 wt %. The present method used by refiners for accomplishing this involves hydrogenating the gasolines to convert undesirable olefins to paraffins. Since the octane number of paraffinic hydrocarbons, especially straight chain, is much lower than the octane number for olefinic hydrocarbons, hydrogenation generally results in a loss of octane number. After hydrogenation to a bromine number of 30, the FCC gasolines would have compositions and properties as follows:

| | FCC Gasoline - After hydrogenation To A Bromine Number of 30 | |
|---|---|---|
| Composition, wt % | A | B |
| Paraffins | 39 | 47 |
| Olefins | 10 | 10 |
| Naphthenes | 17 | 9 |
| Aromatics | 34 | 34 |
| Octane, RON | 85 | 85 |

Thus, hydrogenation to meet bromine number specifications results in a loss of 3 octane numbers for composition A and a loss of 8.5 octane numbers for composition B. In addition, the hydrogenated product would not be a suitable base to which methanol could be added, since the solubility of methanol in paraffinic rich stocks is poor, as compared to its solubility in aromatic or olefinic stocks.

In accordance with the present invention, olefins are removed from cracked gasolines by hydration. This results in a product high in octane and also suitable for stabilization of gasoline methanol blends. After hydrating to convert olefins to a mixture of low molecular weight alcohols, the FCC gasolines would have compositions and properties as follows:

| | FCC Gasoline - After Hydrating | |
|---|---|---|
| Composition, wt % | A | B |
| Paraffins | 31 | 12 |
| Naphthenes | 13 | 9 |
| Aromatics | 37 | 34 |
| Alcohols (RON = 100) | 18 | 45 |
| Octane, RON | 90 | 97 |

For composition A, hydration provides an octane advantage over hydrogenation of 5 octane numbers and an octane advantage over the starting FCC gasoline of 2 octane numbers. The advantage for composition B is 12 octane numbers over hydrogenation and 3.5 over the starting FCC gasoline. In addition, the low molecular weight alcohols formed by hydration serve to solubilize methanol as will be illustrated more fully in the examples set forth hereinafter. Thus, it is apparent that hydration of cracked gasolines provides an effective method for meeting bromine number specifications without losing octane as well as for utilizing methanol to extend gasoline supplies.

The following examples will serve to illustrate the efficacy of the low molecular weight alcohols produced by hydration of stabilizing methanol, without limiting the same.

EXAMPLES 1-10

These examples illustrate the extent of solubility of various mixtures of gasoline and methanol after the addition thereto of low molecular weight alcohols or mixtures of such alcohols similating those contained in a gasoline which has undergone previous hydration to convert the olefins therein to alcohols.

Examples 1-10 were carried out by maintaining mixtures of straight run gasoline and amounts of methanol ranging from 5 to 20 volume percent at 0° F., adding thereto mixtures of $C_4$, $C_5$ and $C_6$ alcohols and observing whether the resulting mixture after 24 hours was soluble or subject to phase separation. The results are shown below in Table I.

TABLE I

| Ex. | Alcohol Added | Vol% | 95 Vol. % St.Run Gasoline 5 Vol% Methanol | 99 Vol. % St.Run Gasoline 10 Vol% Methanol | 85 Vol. % St.Run Gasoline 15 Vol% Methanol | 80 Vol. % St.Run Gasoline 20 Vol% Methanol |
|---|---|---|---|---|---|---|
| 1 | None | — | Phase Separation | Phase Separation | Phase Separation | Phase Separation |
| 2 | Mixture B | 2% | Hazy | Phase Separation | Phase Separation | Phase Separation |
| 3 | | 4% | Soluble | Hazy | Phase Separation | — |
| 4 | | 6% | Soluble | Soluble | Soluble | — |
| 5 | Mixture C | 2% | Soluble | Phase Separation | Phase Separation | — |
| 6 | | 4% | Soluble | Phase Separation | Phase Separation | — |
| 7 | | 6% | Soluble | Soluble | Soluble | — |
| 8 | Mixture D | 2% | Soluble | Phase Separation | Phase Separation | — |
| 9 | | 4% | Soluble | Soluble | Phase Separation | — |
| 10 | | 6% | Soluble | Soluble | Soluble | Soluble |

Mixture B = t-Butanol 50 wt. %, sec-Butanol 50 wt. %
Mixture C = t-Amyl alcohol 33%; 3-Methyl-2-Butanol 34%; 3-Pentanol 33%
Mixture D = 2,3-Dimethylbutanol-2 33%; 3,3-Dimethylbutanol-2 34%; 4-Methylpentanol-2 33%

It will be seen from the above results that in the absence of any added low molecular weight alcohol, i.e. $C_4$, $C_5$ or $C_6$, the mixtures of gasoline and methanol separated into phases in every instance. With the addition of the low molecular weight alcohol to the mixtures of gasoline and methanol such mixtures were rendered soluble with increasing addition in the range of 2 to 6 volume percent of the low molecular weight alcohols.

EXAMPLES 11-14

These examples illustrate the extent of solubility of mixtures of 95 volume percent of reformate gasoline and 5 volume percent of methanol at 25° C. in the presence of small amounts of water and various amounts of added butanol.

TABLE II

| Ex. | Alcohol | Vol % | 95 Vol % Reformate + 5 Vol % Methanol (100 ml. Total) + 0.2 ml. $H_2O$ | + 0.4 ml. $H_2O$ |
|---|---|---|---|---|
| 11 | None | — | Phase Separation | Phase Separation |
| 12 | n-Butanol | 2% | Phase Separation | Phase Separation |
| 13 | | 4% | Soluble | Phase Separation |
| 14 | | 8% | Soluble | Soluble |

From the above results it will be observed that with no added butanol, phase separation was encountered. With increasing amounts of added butanol in the range of 2 to 8 volume percent the gasoline-methanol mixture was rendered soluble even in the presence of water contaminant.

EXAMPLES 15-20

These examples illustrate the extent of solubility of mixtures of 85 volume percent of reformate gasoline and 15 volume percent of methanol at 25° C. in the presence of 1 ml. of water and various amounts of added butanol.

TABLE III

| Ex. | Alcohol | Vol% | 85 Vol% Reformate + 15 Vol% Methanol (100 ml. Total) + 1.0 ml. $H_2O$ |
|---|---|---|---|
| 15 | None | — | Phase Separation |
| 16 | n-Butanol | 2% | Phase Separation |
| 17 | | 4% | Phase Separation |
| 18 | | 6% | Phase Separation |
| 19 | | 8% | Phase Separation |
| 20 | | 10% | Soluble |

From the above results, it will be seen that with no added butanol, phase separation was encountered. Likewise, in view of the large amount of methanol and water contaminant present, phase separation was observed with increasing addition of butanol in the range of 2 to 8 volume percent. With the addition of 10 volume percent of butanol, however, the mixture of gasoline, methanol and water was rendered soluble.

EXAMPLES 21-61

These examples illustrate the extent of solubility of mixtures of 90 volume percent of reformate gasoline and 10 volume percent of methanol at 25° C. in the presence of varying small amounts of water and various added amounts of low molecular weight alcohols.

TABLE IV

| Ex. | Alcohol Used | Vol. % | 90 Vol. % Reformate Gasoline + 10 Vol. % Methanol (100 ml. Total) + 0.2% $H_2O$ | + 0.4% $H_2O$ | + 1.0% $H_2O$ |
|---|---|---|---|---|---|
| 21 | None | — | Phase Separation | Phase Separation | Phase Separation |
| 22 | n-Butanol | 2% | Trace Haze | Phase Separation | Phase Separation |
| 23 | | 3% | Soluble | — | — |
| 24 | | 4% | Soluble | Phase Separation | Phase Separation |
| 25 | | 10% | Soluble | Soluble | Soluble |
| 26 | n-Propanol | 5% | — | — | Phase Separation |
| 27 | | 10% | — | — | Phase Separation |
| 28 | | 12% | Soluble | Soluble | Soluble |
| 29 | sec-Butanol | 14% | Soluble | Soluble | Soluble |
| 30 | Pentanol-2 | 2% | Haze | Haze | Phase Separation |
| 31 | | 3% | Soluble | Haze | Phase Separation |
| 32 | | 14% | Soluble | Soluble | Soluble |
| 33 | Pentanol-3 | 2% | Haze | — | Phase Separation |
| 34 | | 3% | Soluble | — | Phase Separation |
| 35 | | 14% | Soluble | — | Soluble |
| 36 | Hexanol-2 | 2% | Haze | — | Phase Separation |
| 37 | | 3% | Soluble | — | Phase Separation |

TABLE IV-continued

| | | | | | | |
|---|---|---|---|---|---|---|
| 38 | | | 12% | Soluble | — | Soluble |
| 39 | Hexanol-3 | | 2% | Haze (1 ml.) | — | Phase Separation |
| 40 | | | 3% | Soluble | — | Phase Separation |
| 41 | | | 12% | Soluble | — | Soluble |
| 42 | t-Amyl | | 2% | Haze | — | — |
| 43 | | | 3% | Soluble | — | — |
| 44 | 3,3-Dimethyl-butyl | | 2% | Haze | — | — |
| 45 | | | 3% | Soluble | — | — |
| 46 | Cyclohexyl | | 2% | Haze | — | — |
| 47 | | | 4% | Soluble | — | — |
| 48 | Isopropanol | | 2.5% | Hazy* | Phase Separation** | — |
| 49 | | | 5.0% | Soluble* | Hazy** | — |
| 50 | Isopropanol | 1 part | 2.5% | Hazy* | Phase Separation** | — |
| | t-Butanol | 0.5 part | | | | |
| | Sec-Butanol | 0.5 part | | | | |
| | t-Amyl | 0.33 part | | | | |
| | 3-pentanol | 0.33 part | | | | |
| | 3-Methyl-3-Butanol | 0.33 part | | | | |
| | Mixed Hexanols | 1 part | | | | |
| 51 | Isopropanol | 1 part | 5.0% | Soluble* | Phase Separation** | — |
| | t-Butanol | 0.5 part | | | | |
| | Sec-Butanol | 0.5 part | | | | |
| | t-Amyl | 0.33 part | | | | |
| | 3-Pentanol | 0.33 part | | | | |
| | 3-Methyl-3-Butanol | 0.33 part | | | | |
| | Mixed Hexanols | 1 part | | | | |
| 52 | Isopropanol | 1 part | 2.5% | Phase Separation* | Phase Separation** | — |
| | Mixed Butanols | 1 part | | | | |
| | Mixed Pentanols | 1 part | | | | |
| 53 | Isopropanol | 1 part | 5.0% | Soluble* | Phase Separation** | — |
| | Mixed Butanols | 1 part | | | | |
| | Mixed Pentanols | 1 part | | | | |
| 54 | Isopropanol | 1 part | 2.5% | Phase Separation* | Phase Separation** | — |
| | Mixed Butanols | 1 part | | | | |
| 55 | Isopropanol | 1 part | 5.0% | Soluble* | Hazy** | — |
| | Mixed Butanols | 1 part | | | | |
| 56 | t-Butanol | 1 part | 2.5% | Phase Separation* | Phase Separation** | — |
| | Mixed Pentanols | 1 part | | | | |
| | Mixed Hexanols | 1 part | | | | |
| 57 | t-Butanol | 1 part | 5.0% | Soluble* | Phase Separation** | — |
| | Mixed Pentanols | 1 part | | | | |
| | Mixed Hexanols | 1 part | | | | |
| 58 | Mixed Pentanols | 1 part | 2.5% | Soluble* | Phase Separation** | — |
| | Mixed Hexanols | 1 part | | | | |
| 59 | Mixed Pentanols | 1 part | 5.0% | Soluble* | Hazy** | — |
| | Mixed Hexanols | 1 part | | | | |
| 60 | Isopropanol | 1 part | 2.5% | Hazy* | Phase Separation** | — |
| | Mixed Pentanols | 1 part | | | | |
| | Mixed Hexanols | 1 part | | | | |
| 61 | Isopropanol | 1 part | 5.0% | Soluble* | Phase Separation** | — |
| | Mixed Pentanols | 1 part | | | | |
| | Mixed Hexanols | 1 part | | | | |
| 62 | Mixed Pentanols | 1 part | 6.5% | Soluble* | Soluble** | — |
| | Mixed Hexanols | 1 part | | | | |

*0.25% $H_2O$ in place of 0.20% $H_2O$
**0.5% $H_2O$ in place of 0.4% $H_2O$

EXAMPLE 62

A TCC gasoline having the following hydrocarbon composition:

| Gasoline Components | Weight Percent |
|---|---|
| Paraffins | 22 |
| Olefins | 30 |
| Naphthenes | 10 |
| Aromatics | 30 |
| Indanes, Tetralins | 8 |
| Naphthalenes | |

is hydrated with water, utilizing a water:olefinic hydrocarbon molar ratio of 2:1. The hydration operation is carried out by contacting about 250 gallons of the above gasoline with 36 gallons of water in the presence of 30 pounds of a resin sulfonic acid catalyst at a temperature of 105° C. and a pressure of 400 psi for a period of 0.5 hour.

The resulting gasoline containing mixed low molecular weight alcohols is blended in an amount of 5 volume percent with a straight run gasoline to which 10 volume percent of methanol is added.

The gasoline-alcohol product so obtained is stable against phase separation even at a temperature as low as 0° F.

EXAMPLE 63

An FCC gasoline having the following hydrocarbon composition:

| Gasoline Components | Weight Percent |
|---|---|
| Paraffins | 25 |
| Olefins | 20 |
| Naphthenes | 11 |

-continued

| Gasoline Components | Weight Percent |
|---|---|
| Aromatics | 38 |
| Indanes, Tetralins | 6 |
| Naphthalenes | |

is hydrated with water, utilizing a water olefinic hydrocarbon molar ratio of 2:1. The hydration operation is carried out by contacting 250 gallons of the above gasoline with 40 gallons of water in the presence of about 1 pound of commercial concentrated sulfuric acid as catalyst at a temperature of 50° C. and a pressure of 100 psi for a period of 0.5 hour.

The resulting gasoline containing mixed low molecular weight alcohols is blended in an amount of 10 volume percent with a reformate gasoline to which 15 volume percent of methanol is added.

The gasoline-alcohol product so obtained is stable against phase separation even at a temperature as low as 0° F.

I claim:

1. A method for reducing the olefin content of cracked gasoline and for producing a high octane stabilized gasoline-alcohol fuel blend which comprises, in combination:

(a) hydrating a cracked gasoline or a fraction thereof high in olefins to form a mixture containing between about 10 and 60% by weight of low molecular weight alcohols, whereby reducing the olefin content of said gasoline without loss in octane; and without separation of the alcohols from said mixture, (b) blending an amount of the resultant high alcohol content gasoline with a major proportion of gasoline and 5 to 20 volume percent of methanol, said amount, based on alcohol content, being between about 2 and about 20 volume percent of the gasoline-methanol mixture, whereby producing a fuel blend in which said methanol is not suceptible of separation at low temperatures or in the presence of water.

2. The method of claim 1 wherein the mixture of low molecular weight alcohols consist essentially of $C_2$–$C_9$ alcohols.

3. The method of claim 1 wherein the mixture of low molecular weight alcohols consist essentially of $C_5$–$C_7$ alcohols.

4. The method of claim 1 wherein the mixture of low molecular weight alcohols consist essentially of $C_4$–$C_7$ alcohols.

5. The method of claim 1 in which said hydration is carried out in the presence of an acid catalyst, at a temperature between about 50° C. and about 300° C. and a pressure between about 1 and about 500 atmospheres, utilizing a water/olefinic hydrocarbon ratio within the approximate range of 1:1 to 5:1.

6. The method of claim 1 wherein said low molecular weight alcohols comprise tertiary and secondary alcohols.

7. The method of claim 1 wherein the alcohol portion of the stabilized gasoline-alcohol fuel blend contains a major proportion of methanol, a primary alcohol, and lesser amounts of tertiary and secondary alcohols.

8. A stabilized gasoline-alcohol fuel blend consisting essentially of a major proportion of gasoline and 5 to 20 volume percent of methanol, together with an amount of gasoline containing between about 2 and about 20 volume percent of the gasoline-methanol mixture of mixed low molecular weight alcohols resulting from hydration of a gasoline or fraction thereof high in olefins, said amount based on alcohol content, being between about 2 and about 20 volume percent of the gasoline-methanol mixture.

9. The stabilized gasoline-alcohol fuel blend of claim 8 wherein said mixed low molecular weight alcohols consist essentially of $C_2$–$C_7$ alcohols.

10. The stabilized gasoline-alcohol fuel blend of claim 8 wherein said mixed low molecular weight alcohols consist essentially of $C_5$–$C_7$ alcohols.

11. The stabilized gasoline-alcohol fuel blend of claim 8 wherein said mixed low molecular weight alcohols consist essentially of $C_4$–$C_7$ alcohols.

* * * * *